US007688991B2

(12) United States Patent
Baechler et al.

(10) Patent No.: US 7,688,991 B2
(45) Date of Patent: Mar. 30, 2010

(54) HEARING ASSISTANCE SYSTEM AND METHOD OF OPERATING THE SAME

(75) Inventors: Herbert Baechler, Meilen (CH); Francois Callias, Fontaines (CH); Stefan Haenggi, Murten (CH)

(73) Assignee: Phonak AG, Staefa (CH)

( * ) Notice: Subject to any disclaimer, the term of this patent is extended or adjusted under 35 U.S.C. 154(b) by 980 days.

(21) Appl. No.: 11/420,130

(22) Filed: May 24, 2006

(65) Prior Publication Data

US 2007/0274550 A1 Nov. 29, 2007

(51) Int. Cl.
*H04R 25/00* (2006.01)

(52) U.S. Cl. ..... 381/315; 381/312

(58) Field of Classification Search ..... 381/23.1, 381/312, 314, 315, 317, 320, 321, 370; 379/52; 455/41.2, 63.1

See application file for complete search history.

(56) References Cited

U.S. PATENT DOCUMENTS 5,434,924 A * 7/1995 Jampolsky ..... 381/23.1
5,991,419 A * 11/1999 Brander ..... 381/312
6,549,633 B1 4/2003 Westermann
6,587,568 B1 7/2003 Sigwanz
6,763,116 B2 7/2004 Barthel et al.
6,768,802 B1 7/2004 Baechler
6,839,447 B2 1/2005 Nielsen et al.
7,016,510 B2 3/2006 Arndt et al.
7,580,535 B2 * 8/2009 Baechler ..... 381/315
2006/0018496 A1 1/2006 Niederdrank et al.

FOREIGN PATENT DOCUMENTS

EP 1 501 200 A2 1/2005

* cited by examiner

*Primary Examiner*—Huyen D Le
(74) *Attorney, Agent, or Firm*—David S. Safran; Roberts Mlotkowski Safran & Cole, P.C.

(57) ABSTRACT

There is provided a method of operating a hearing assistance system comprising a hearing device (10, 110, 210), which comprises means (24) for stimulating a user's hearing and which is worn at one of the user's ears, and a remote device (12, 30, 40) spaced apart from the hearing device. The method comprises: establishing a wireless link (26) between the hearing device and the remote device for transmitting signals from the remote device to the hearing device, and operating the system in a base mode; detecting whether a source (28) of radio frequency signals interfering with the wireless link and having a transmission power changing according to a predictable scheme between low power regimes and high power regimes is present in the vicinity of the hearing device; and operating the system in an interference mode as long as the presence of such source of periodic signals interfering with the wireless link is detected, in which interference mode the transmission of the signals from the remote device to the hearing device is synchronized to the detected power scheme of the interfering signals in such a manner that the signals are transmitted only during the low power regimes.

29 Claims, 2 Drawing Sheets

HEARING ASSISTANCE SYSTEM AND METHOD OF OPERATING THE SAME

BACKGROUND OF THE INVENTION

1. Field of the Invention

The invention relates to a hearing assistance system comprising a hearing device which comprises means for stimulating the user's hearing and which is to be worn at one of the user's ears and a remote device spaced apart from the hearing device, wherein a wireless link is established between the hearing device and the remote device in order to transmit signals from the remote device to the hearing device. The invention also relates to a method of operating such a hearing assistance system.

2. Description of Related Art

Examples of such hearing assistance systems are binaural hearing aids (in this case the remote device is a hearing instrument which is worn at the other one of the user's ears, with both hearing instruments being hearing aids comprising a microphone and an output transducer); in this case the link may serve as a bi-directional data link for exchanging audio signals, control data, and/or commands between the hearing aids.

Other examples of such a hearing assistance systems are CROS or BiCROS systems (in this case the remote device is a wireless microphone worn at the other one of the user's ears). In a CROS (also spelled CROSS) system the hearing instrument does not comprise a microphone, while in a BiCROS (also spelled BiCROSS) system the hearing instrument comprises a microphone, depending on whether the ear at which the hearing instrument is worn needs hearing assistance or not. In both cases the ear at which the wireless microphone is worn is essentially inaidable by a hearing instrument.

According to further examples of such hearing assistance systems the remote device is a remote control for the hearing instrument (in this case the link is for transmitting control data and/or commands from the remote control to the hearing instrument), an external microphone worn by another person (for example a teacher) or an external microphone worn by the user at a place other than the ears, or a device for wireless transmission of audio signal from a external audio signal source, such as a telephone, a television, an external microphone, a hi-fi-system, etc.

Generally, the receiver unit for the wireless link could be integrated within the hearing instrument/hearing aid, or the receiver unit could be a separate device which is mechanically and electrically connected to the hearing instrument/hearing aid, usually via an "audio shoe" in order to provide the audio signals received over the wireless link to an audio input of the hearing aid.

In such known systems the wireless link from the remote device to the receiver unit included in or connected to the hearing instrument may be heavily disturbed if a source of interfering radio frequency signals comes close to the hearing instrument. A typical example for such interfering radio frequency source is a mobile phone. Typically, a mobile phone transmits TDMA (time division multiple access) signals, for example according to the GSM (global system for mobile communications) standard. In this case transmission from the mobile phone occurs periodically, with only ⅛ of the time being used for transmission. A similar periodic transmission scheme is found in cordless telephone systems using the DECT standard; also in this case only a relatively small fraction of each period is used for transmission. This applies similarly also to devices using the Bluetooth standard.

If such interfering radio frequency source is brought very close to the hearing instrument worn had the user's ear, the link between the remote device and the hearing instrument may brake down, what is very inconvenient for the user. Such radio frequency sources may be considered as "burst interferes".

Examples of wireless links for binaural hearing aid systems are found in U.S. Pat. No. 6,549,633 B1 and US 2004/0037442 A1.

According to US 2005/0117764 A1 the use of a DECT or GSM phone at one of the two sides of a hearing aid set is detected by analyzing the level difference between the left ear and right ear hearing coil in order switch the respective hearing aid to a phone mode.

According to U.S. Pat. No. 6,587,568 B1 and EP 1 501 200 A2 a hearing aid is capable of recognizing periodic RF (radio frequency) interference signals, for example from mobile phones, with the gain of the hearing aid being synchronized to the periodicity of the RF interference signals, so that the gain of the hearing aid is reduced or even set to zero during the presence of an interfering RF burst. According to US 2003/076974 A1 a hearing aid is capable of detecting the presents of characteristic RF interference signals in order to not only switch the gain of the hearing aid accordingly but also to switch other parameters, such as the filter band width, of the hearing aid accordingly. Thereby specific auditory scenes can be recognized, in particular the use of a telephone in order to adapt the operation mode of the hearing aid accordingly.

It is an object of the invention to provide for a hearing assistance system comprising a hearing device and a remote device, with a wireless link being established between the hearing device and the remote device for transmitting signals from the remote device to the hearing device, wherein the system should provide for a reliable wireless link even in the presence of a source of radio frequency signals interfering with the wireless link, which have a transmission power changing according to a predictable scheme. It is a further object to provide for a corresponding method for operating such a system.

SUMMARY OF THE INVENTION

These objects are achieved by a method as defined in claims 1 and 2, respectively, and a system as defined in claims 26 and 27, respectively. The invention in general is beneficial in that, by operating the system in an interference mode, in which the transmission from the remote device to the hearing device is adapted to the scheme of the low power regimes, i.e. the idle times, of the interfering radio frequency signals, as long as the presence of such signals interfering with the wireless link is detected, the high power regimes, i.e. the bursts, of the interfering radio frequency signals are prevented from fully interfering with the link so that breakdown of the link can be avoided.

The aspect of the invention as defined in claims 1 and 26 is particularly beneficial in that, by synchronizing the transmission of the signals via the wireless link to the power scheme of the interfering radio frequency signals in such a manner that the signals are transmitted and received only during the low power regimes of the interfering radio frequency signals, the high power regimes of the interfering radio frequency signals are completely prevented from interfering with the link, while the low power regimes are utilized as completely as possible for transmission so that the remaining bandwidth of the link is maximized.

The aspect of the invention as defined in claims 2 and 27 is particularly beneficial in that, by controlling the transmission of the signals from the remote device to the hearing device in such a manner that the signals are transmitted in packets each having a length of not more than half the length of the shortest one of the low power regimes, with each packet subsequently being transmitted twice, a relatively simple solution is obtained, with no synchronization of the transmission to the power scheme of the interfering radio frequency signals being necessary, while nevertheless complete reception of the transmitted signal packets is achieved, although at the cost of reduced efficiency, since e.g. only half of the duration of the low power regimes is effectively utilized for transmission.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
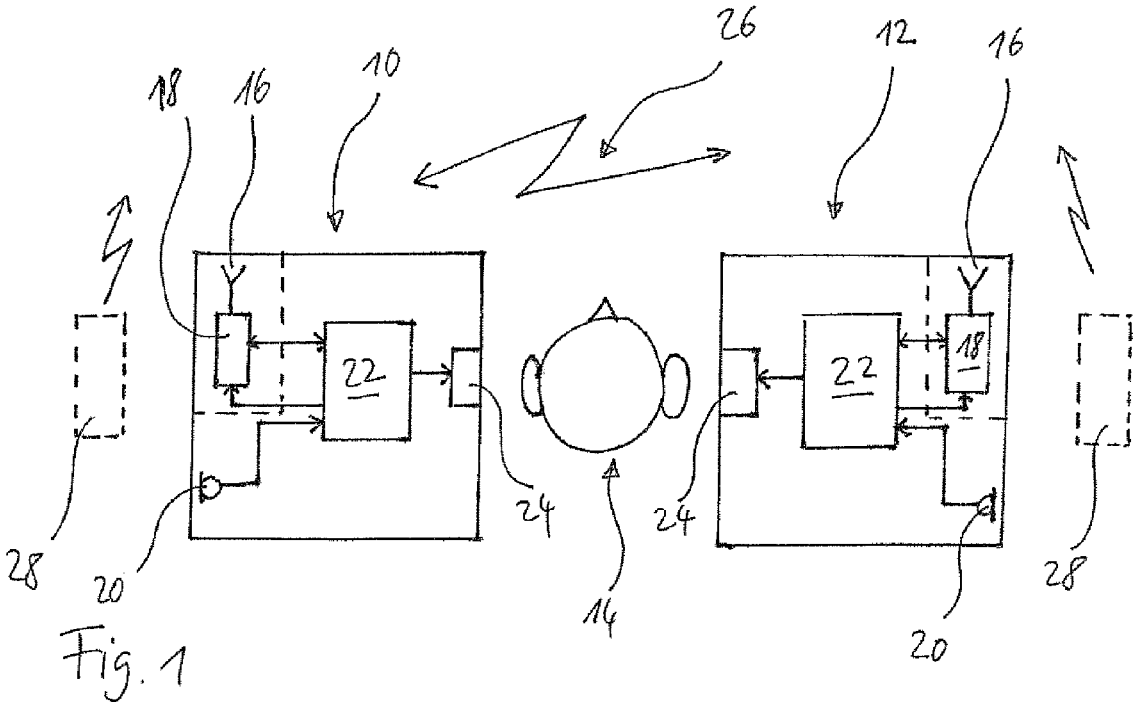
FIG. 1 is a block diagram of an example of a binaural hearing aid system according to the invention.

FIG. 1 is a block diagram of a binaural hearing aid system comprising a left-ear hearing aid 10 and a right-ear hearing aid 12 worn at the right and left ear of a user 14, respectively. Each hearing aid 10, 12 comprises an antenna 16, a receiver/transmitter unit 18, a microphone 20, a central processing unit 22 and an output transducer 24. The antenna 16 and the receiver/transmitter unit 18 enable communication between the hearing aids 10 and 12 via a wireless link 26 which may be an inductive link (utilization of the near field) or a radio frequency (RF) link (utilization of the far field), such as a frequency modulated (FM) link, for example a frequency shift keying (FSK) link, or an ultra-wide-band link. The link 26 is bi-directional and may serve to exchange audio signals and/or control data and commands between the hearing aids 10, 12. As will be explained subsequently, the audio signals are captured by the respective microphone 20, and the control data/commands may relate to the present setting of the respective hearing aid 10, 12 according to the present auditory scene determined by auditory scene analysis performed by the central processing unit 22. The link 26 may be a time division multiplex link or it may be a frequency division multiplex link.

The microphone 20 captures audio signals which are supplied to the central processing unit 22 in order to generate an input audio signal for the output transducer 24. Usually processing of the audio signals provided by the microphone 20 occurs depending on the auditory scene as analyzed by the central processing unit 22 in order to optimize perception of sound by the user 14. In a binaural system the central processing unit 22 exchanges audio signals and control data with the receiver transmitter unit 18 which has been received by the antenna 16 from the other hearing aid via the link 26 or which are to be transmitted to the other hearing aid via the link 26. The receiver/transmitter unit 18 is controlled by the central processing unit 22. In the central processing unit 22 audio signals received from the other hearing aid, i.e. from the other ear, may be added to the audio signals from the microphone 20, and also processing of the audio signals from the microphone 20 may be performed by taking into account information provided from the other hearing aid, whereby the perception of sound by the user 14 can be significantly improved.

The output transducer 24 serves to simulate the user's hearing and may be an electro-acoustic transducer (i.e. a loudspeaker), an electro-mechanical output transducer mechanically coupled to the ear, or a cochlea implant.

Examples of binaural hearing aid systems comprising a wireless link between the hearing aids are given in U.S. Pat. No. 6,549,633 B1, US 2004/0037442 A1 and US 2006/0018496 A1.

During practical use of the hearing aids 10, 12 the link 26 may be disturbed by the presence of a source 28 of radio frequency signals interfering with the link 26 and having an amplitude changing periodically between a low amplitude regime ("idle time") and a high amplitude regime ("burst"), i.e. the energy of the interfering RE signals changes periodically. An example of such interfering RE signal source 28 is a mobile phone which is used at one of the ears of the user 14 and hence in close proximity to one of the hearing aids 10, 12. Mobile phones usually emit time-division-multiple-access (TBMA) signals, which often obey the GSM standard.

Figure 4:
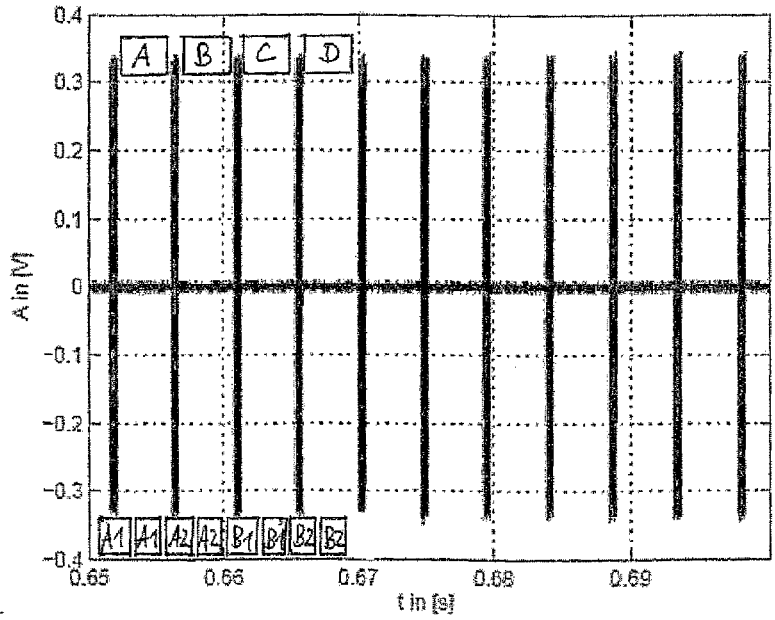
FIG. 4 is a diagram an example of the amplitude of a GSM signal versus time, shown together with two examples of the data packets transmitted by a system according to the invention in the interference mode.

An example of a GSM signal is shown in FIG. 4. GSM signals use frequency bands at 900 MHz and 1800 MHz with a maximum transmission power of 2 W and 1 W, respectively. A GSM signal is divided into frames, each having a length of 4.62 msec. Each frame is divided into 8 time slots, each having a length of 0.58 msec. One of these 8 time slots is dedicated to the respective GSM device, so that each GSM device transmits only during ⅛ of each frame, i.e. the GSM device periodically transmits bursts having a length of 0.58 msec with a repetition period of 4.62 msec. Thus a GSM signal can be considered as a signal having an amplitude changing periodically between a low amplitude regime during which the amplitude is essentially zero and which has a duration of about 4.04 msec. and a high amplitude regime during which the amplitude is essentially constant and which has a duration of about 0.58 msec. In the following, the high amplitude regime also will be labeled as "bursts", while the low amplitude regime also will be labeled "idle time".

Signals of similar structure and at similar frequency bands are also emitted by devices using the DECT standard, which is commonly used for cordless phones and which is divided into time frames of a length of 10 msec. which are divided into time slots having a duration of about 0.42 msec., or by devices using the Bluetooth standard, which has a burst repetition period of 1.25 msec., with each burst lasting for 0.37 msec.

Without counter-measures, the link 26 between the hearing aids 10 and 12 would be heavily disturbed and usually would break down during transmission of the bursts of an RF interfering device 28 if such device 28 was used at one of the ears of the user 14. In this respect it has to be noted that the bursts primarily would disturb reception of the signals transmitted via the link 26, while transmission of the signals essentially would not be affected. Due to the relatively small distance between the ears in most cases reception of the signals transmitted via the link 26 would be heavily disturbed by the RF interfering device 28 both in the case which the device 28 is used at that hearing aid which is presently receiving and in the case in which the device 28 is used at that hearing aid which is presently transmitting. However, there may be cases in which heavy disturbance of the reception occurs only if the interfering device 28 is used at that hearing aid which is presently receiving.

In order to avoid disturbance of the link 26—and in particular to avoid loss of data—during the presence of a RF interfering device 28 the binaural system is designed such that it is permanently detected whether a source 28 of RF signals interfering with the link 26 and having an amplitude changing periodically between a low amplitude regime and a high amplitude regime is present in the vicinity of one of the hearing aids 10, 12 (as already mentioned above, in some cases it may be sufficient to detect only whether such source 28 is present in the vicinity of that hearing aid which is presently receiving). During times in which no presence of an interfering RF source is detected, the binaural system is operated in a base mode, i.e. a conventional wireless data/audio signal exchange mode. As long as the presence of a source of interfering RF signals is detected, the system switches into an interference mode in which the transmission of signals via the link 26 is synchronized to the periodicity of the amplitude of the interfering RF signals in such a manner that the signals are transmitted via the link 26 only during the low amplitude regime, i.e. the idle times of the interfering RF signals.

In most cases it will be necessary that transmission from any of the two hearing aids 10, 12 occurs in the interference mode irrespective of the question at which of the two hearing aids 10, 12 the interfering device 28 is used. As already mentioned above, in some cases it may be sufficient that only transmission from that hearing aid at which the interfering device 28 is not used occurs in the interference mode while transmission from that hearing aid at which the interfering device 28 is used may occur in the base mode.

Further, in view of the fact that the interfering device 28 usually will be a phone, in the interference mode preferably audio signals captured by that hearing aid to which the interfering device 28 is closer are not only presented to the respective ear via the output transducer 24 of that hearing aid, but are also transmitted via the link 26 to the other hearing aid for being presented also to the other ear of the user.

According to one embodiment, the presence of the interfering device 28 may be detected by monitoring the quality of the link 26 by one or both of the hearing aids 10, 12. According to an alternative embodiment, one or both of the hearing aids 10, 12 may be provided with a dedicated circuit for this purpose.

Synchronization of the transmission of the signals via the link 26 in the interference mode may be achieved by measuring the amplitude of the interfering radio frequency signals in time domain and predicting the idle time periods, i.e. the periods of time during which the low amplitude regime will prevail. Preferably the system is designed such that it can be determined to which of the hearing aids 10, 12 the interfering device 28 is closer. According to one embodiment, this can be realized by monitoring the symmetry of the quality of the link 26 by the two hearing aids 10, 12. According to an alternative embodiment, to this end the audio signals captured by each of the hearing aids 10, 12 via the microphone 20 may be analyzed.

The control of the two hearing aids 10, 12 regarding the interference mode may be realized by a symmetric architecture or by a master/slave architecture; in the latter case one of the hearing aids 10, 12 would be the master while the other one would be the slave.

An example of the data/audio signal transmission in the interference mode is shown in the upper part of FIG. 4, according to which the data to be transmitted is divided into packets A, B, C, D, etc. of equal length which is slightly less than the duration of the idle time period between two adjacent bursts of the GSM interfering signal. The data packets A, B, . . . are transmitted only during the idle time periods so that there is no overlap with the bursts.

According to an alternative embodiment, transmission of the signals in the interference mode may be controlled such that the signal is transmitted in packets A1, A2, B1, B2, etc. having a length of not more than half of the idle time period, i.e. the period length of the low amplitude regime, with each packet subsequently being transmitted twice. In this case no synchronization of the transmission with the idle time periods is necessary, since by reducing the packet length to half of the idle time period length and by transmitting each packet twice it is ensured that each packet is transmitted once completely within an idle time period without overlap with the bursts. This is also apparent from the lower part of FIG. 4. In this example, the packet A of the upper part of FIG. 4 has been divided into two portions A1 and A2, and the packet B has been divided into two packets B1, B2, etc. It is apparent that this simpler solution, which does not require synchronization to the phase of the interfering signal, the data transmission rate is roughly reduced by a factor of 2 due to the need to transmit each packet twice so that the bandwidth is reduced accordingly in the interference mode. By contrast, according to the solution in which transmission occurs only during the idle time periods the bandwidth is reduced only slightly with respect to the base mode (i.e. only by about ⅛).

The invention is applicable not only to binaural hearing aid systems; rather, it is generally applicable to any hearing assistance system comprising a hearing instrument which is connected to a remote device, i.e. a device spaced apart from the hearing instrument, via a wireless link for receiving data/audio signals from that remote device. Consequently, the embodiment of FIG. 1 may be considered as a specific case of this general concept wherein the remote device is the second hearing aid.

Figure 2:
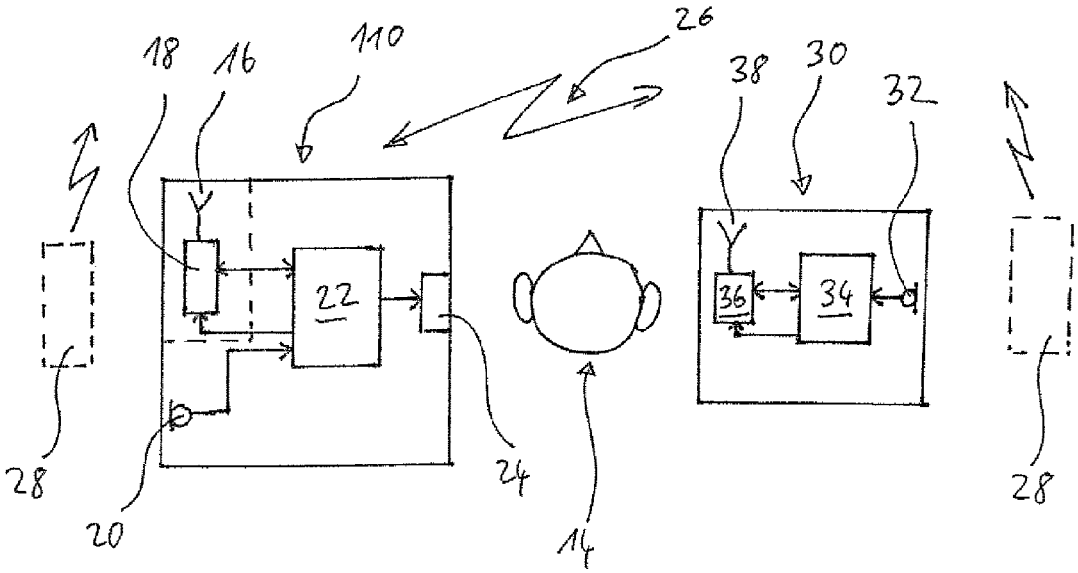
FIG. 2 is a block diagram of an example of a CROS/BiCROS system according to the invention.

In FIG. 2 an example is shown in which the remote device is a wireless microphone unit 30 of a CROS or BiCROS system. The microphone unit 30 is connected via a wireless link 26 with a hearing instrument 110 which is generally similar to the hearing aid 10 of FIG. 1. In the case of a CROS system, the hearing instrument 10 would not include the microphone 20.

The hearing instrument 110 is worn at the better ear of the user 14, while the microphone unit 30 is worn at the worse ear. The microphone unit 30 comprises a microphone 32, a central processing unit 34, a receiver transmitter unit 36 and an antenna 38. The audio signals generated by the microphone 32 are processed in the central unit 34 and then are supplied to the receiver/transmitter unit 36 for being transmitted via the antenna 38 over the link 26 to the hearing instrument 110 in order to be presented via the output transducer 26 to the better ear of the user 14. In a BiCROS system these audio signals will be combined in the central processing unit 22 of the hearing instrument 110 with audio signals captured by the microphone 20 of the hearing instrument 110.

If the presence of an interfering device 28 at the hearing instrument 110 is detected, transmission of the audio signals from the microphone unit 30 will occur in the interference mode. In most cases this will also apply if an interfering device 28 is detected at the microphone unit 30. Detection of the presence of an interfering device 28 at the hearing instrument 110 or the microphone unit 30 may be performed by the hearing instrument 110 and/or the microphone unit 30. If detection of the interfering device 28 is not performed in the microphone unit 30, corresponding information has to be transmitted to the microphone unit 30 from the hearing instrument 110; such information may include the confirmation that transmission has to occur in the interference mode, information regarding where the interfering device 28 is located (i.e. at the hearing instrument 110 or the microphone unit 30), information regarding the burst length and the idle time length, and information regarding the phase of the interfering signal (this is necessary only if in the interference mode the transmission has to be synchronized to the phase of the idle times).

Figure 3:
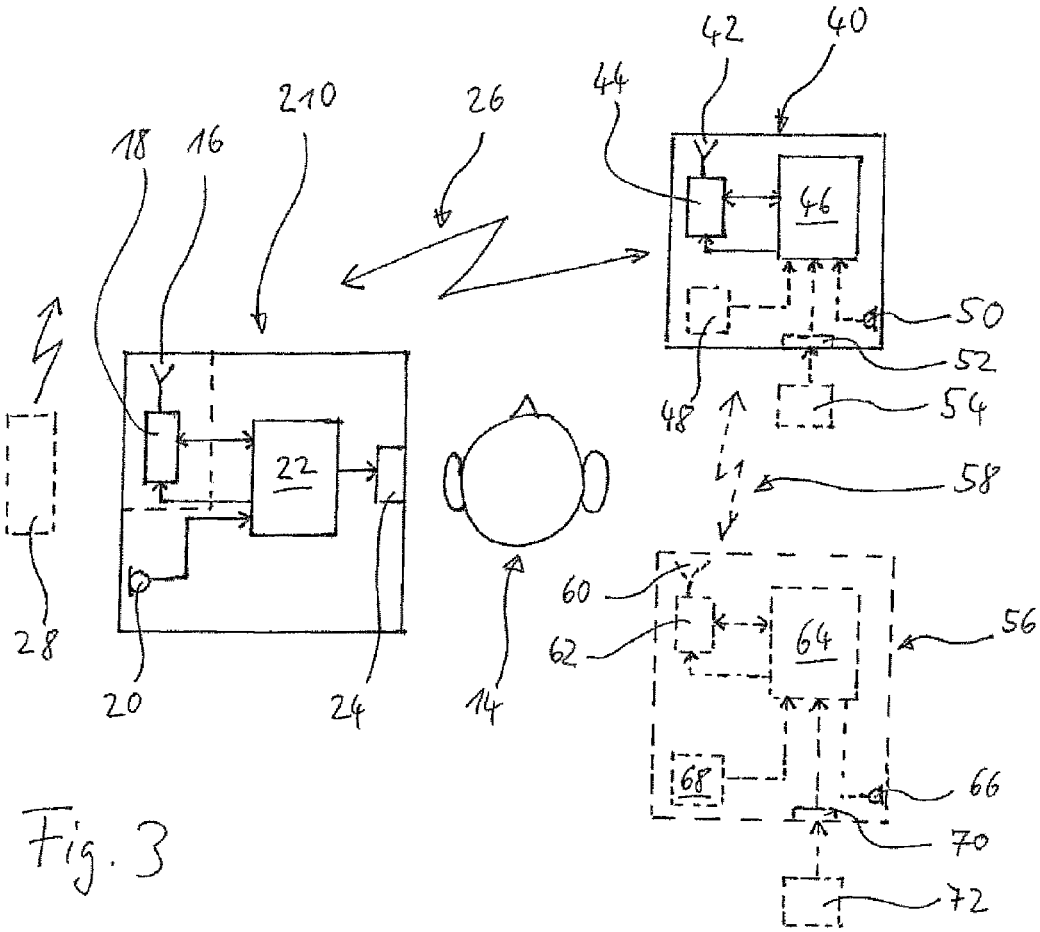
FIG. 3 is a block diagram of an example of a system according to the invention comprising a hearing aid and an accessory device connected via a wireless link to the hearing aid.

In FIG. 3 an embodiment is shown wherein the remote device is an accessory device 40 which is connected to a hearing instrument 210 worn at one of the user's ears via a wireless link 26 (usually the system will comprise a second hearing instrument (not shown in FIG. 3) worn at the other one of the user's ears). The accessory device 40 may be designed for use by another person, such as a teacher teaching hearing-impaired pupils in a classroom, or it may be designed for being worn or used by the person 14 using the hearing instrument 210. In the latter case, the accessory device 40 may be worn somewhere at the user's body, except for the head. Further, the accessory device 40 could designed for stationary use somewhere in the room where the user 14 of the hearing instrument 210 stays.

Usually the accessory device 40 will comprise at least an antenna 42, a receiver/transmitter unit 44 and a central processing unit 46. The central processing unit 46 controls the receiver/transmitter unit 44 and provides the data to be transmitted via the antenna 42 over the link 26 to the hearing instrument 210.

According to one embodiment, the accessory device 40 may serve as a remote control of the hearing instrument 210. In this case, it will comprise some kind of operating panel 48. Alternatively or in addition, the accessory device 40 may serve as an audio signal source for the hearing instrument 210. To this end, it may be provided with a microphone 50 and/or an input 52 for an external audio source 54, such as a phone, a television device, a hi-fi-system, etch.

Rather then being directly connected to the accessory device 40 via the input 52, such external audio source also could be represented by a device 56 which is connected to the accessory device 40 via a wireless link 58. Such external device 56 may include an antenna 60, a transmitter 62, a central unit 64, a microphone 66, an audio signal source 68 and/or an input 70 for an audio source 72.

In the embodiment of FIG. 3 it is sufficient to detect whether an interfering device 28 is close to the hearing instrument 210. Such detection usually will be performed by the hearing instrument 210; however, it is also conceivable to perform such detection by the accessory device 40. As soon as the presence of an interfering device 28 is detected, transmission of the signals from the accessory device 40 will occur in the interference mode. In case that detection is performed in the hearing instrument 210, corresponding information will have to be transmitted from the hearing instrument 210 to the accessory device 40. In case that the detection is performed in the accessory device 40, no such transmission of information will be necessary.

In the above embodiments the antenna 16 and receiver/transmitter unit 18 have been shown as a part of the hearing instrument 10, 110, 210. However, according to an alternative embodiment, all elements necessary for the link 26 could be part of a separate receiver/transmitter unit which is mechanically and electrically connected to the hearing instrument 10, 110, 210, e.g. via an audio shoe (this is indicated by a dashed line around 16, 18 in FIGS. 1 to 3).

Moreover, in the above embodiments only periodic interfering FM signals have been discussed in which idle times and bursts are repeated subsequently. However, the present invention is generally applicable to any interfering FM signals which have a transmission power changing according to a predictable scheme between low power regimes and high power regimes. In that case, transmission of the signals from the remote device to the hearing device are synchronized to the detected power scheme of the interfering signals in such a manner that the signals are transmitted only during the low power regimes. To this end, the hearing device will identify the detected power scheme in order to predict the times of the low power regimes, e.g. with the help of a library of known transmission power schemes. According to an alternative embodiment, the transmission of the signals from the remote device to the hearing device is controlled such that the signals are transmitted in packets each having a length of not more than half the length of the shortest one of the low power regimes of the detected power scheme, with each packet subsequently being transmitted twice.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A method of operating a hearing assistance system comprising a hearing device, which comprises means for stimulating a user's hearing and which is worn at one of the user's ears, and a remote device spaced apart from said hearing device, said method comprising:

establishing a wireless link between said hearing device and said remote device for transmitting signals from said remote device to said hearing device, and operating said system in a base mode;

detecting whether a source of radio frequency signals interfering with said wireless link and having a transmission power changing according to a predictable scheme between low power regimes and high power regimes is present in a vicinity of said hearing device; and operating said system in an interference mode as long as a presence of such source of signals interfering with said wireless link is detected, in which interference mode transmission of signals from said remote device to said hearing device is synchronized to said detected power scheme of said interfering signals in such a manner that said signals are transmitted only during said low power regimes.

2. The method of claim 1, wherein said signals transmitted via said wireless link comprise audio signals from said remote device.

3. The method of claim 2, wherein said remote device is a hearing device which comprises means for stimulating said user's hearing and which is worn at the other one of the user's ears.

4. The method of claim 3, wherein both hearing devices comprise at least one microphone, and wherein said wireless link is a bi-directional audio signal link for exchanging audio signals captured by each of said microphones between said hearing devices.

5. The method of claim 4, wherein it is determined to which of said hearing devices said source of interfering radio frequency signals is closer.

6. The method of claim 5, wherein it is determined to which of said hearing devices said source of interfering radio frequency signals is closer by monitoring a symmetry of a quality of said wireless link.

7. The method of claim 5, wherein it is determined to which of said hearing devices said source of interfering radio frequency signals is closer by analyzing audio signals captured by each of said hearing devices.

8. The method of claim 5, wherein in said interference mode audio signals captured by that hearing device to which said source of interfering radio frequency signals is closer are presented to a respective ear of said user by that hearing device and also are transmitted to the other hearing device for being presented to the other ear of said user by the other hearing device.

9. The method of claim 5, wherein as long as a presence of said source of interfering radio frequency signals is detected at one of said two hearing devices, transmission from that hearing device to which said source of interfering radio frequency signals is closer occurs in said base mode, whereas transmission from the other one of said hearing devices occurs in said interference mode.

10. The method of claim 4, wherein transmission from both hearing devices occurs in said interference mode as long as a presence of said source of interfering radio frequency signals is detected at least one of said two hearing devices.

11. The method of claim 3, wherein said wireless link serves as a bi-directional data link for exchanging at least one of control data and commands between said hearing devices.

12. The method of claim 2, wherein said remote device is a microphone unit which is worn at the other one of the user's ears.

13. The method of claim 2, wherein said remote device comprises an external microphone and is worn by at least one of another person and said user.

14. The method of claim 2, wherein said remote device is a device for wireless transmission of audio signals from an audio signal source to said hearing device.

15. The method of claim 1, wherein said signals transmitted via said wireless link comprise at least one of control data and commands for controlling said hearing device.

16. The method of claim 15, wherein said remote device is a remote control for said hearing device.

17. The method of claim 1, wherein a presence of said source of interfering radio frequency signals is detected by monitoring a quality of said wireless link.

18. The method of claim 1, wherein in said interference mode transmission of said signals from said remote device to said hearing device is synchronized to said power scheme of the interfering signals by measuring a power of said interfering radio frequency signals in time domain and predicting the periods of time during which said low power regimes prevail.

19. The method of claim 1, wherein said source of interfering radio frequency signals is one of a mobile phone and a cordless phone used by said user at one of the ears.

20. The method of claim 1, wherein said wireless link is one of an inductive link and a radio frequency link.

21. The method of claim 1, wherein said interfering radio frequency signals are Time-Division-Multiple-Access signals.

22. The method of claim 21, wherein said interfering radio frequency signals obey a GSM-signal.

23. The method of claim 1, wherein said power scheme of said interfering radio frequency signals is periodic.

24. The method of claim 23, wherein said power scheme is a periodically repeated alternating sequence of a high power regime and a low power regime.

25. A method of operating a hearing assistance system comprising a hearing device, which comprises means for stimulating a user's hearing and which is worn at one of the user's ears, and a remote device spaced apart from said hearing device, comprising:

establishing a wireless link between said hearing device and said remote device for transmitting signals from said remote device to said hearing device, and operating the system in a base mode;

detecting whether a source of radio frequency signals interfering with said wireless link and having a transmission power changing according to a predictable scheme between low power regimes and high power regimes is present in the vicinity of said hearing device; and operating said system in an interference mode as long as a presence of such source of signals interfering with said wireless link is detected, in which interference mode transmission of signals from said remote device to said hearing device is controlled such that said signals are transmitted in packets each having a length of not more than half a length of a shortest one of said low power regimes of said detected power scheme, with each packet subsequently being transmitted twice.

26. A hearing assistance system comprising a hearing device, which comprises means for stimulating a user's hearing and which is worn at one of said user's ears, and a remote device spaced apart from said hearing device, said system further comprising:

means for establishing a wireless link between said hearing device and said remote device for transmitting signals from said remote device to said hearing device, means for detecting whether a source of radio frequency signals interfering with said wireless link and having a transmission power changing according to a predictable scheme between low power regimes and high power regimes is present in a vicinity of said hearing device, a control unit adapted for operating said system in a base mode unless a presence of such source of signals interfering with said wireless link is detected by said detecting means and for operating said system in an interference mode as long as a presence of such source of signals interfering with said wireless link is detected by said detecting means, in which interference mode transmission of said signals from said remote device to said hearing device is synchronized to said detected power scheme of said interfering signals in such a manner that said signals are transmitted only during said low power regimes.

27. A hearing assistance system comprising a hearing device, which comprises means for stimulating a user's hearing and which is worn at one of the user's ears, and a remote device spaced apart from said hearing device, said system further comprising:

means for establishing a wireless link between said hearing device and said remote device for transmitting signals from said remote device to said hearing device, means for detecting whether a source of radio frequency signals interfering with said wireless link and having a transmission power changing according to a predictable scheme between low power regimes and high power regimes is present in a vicinity of said hearing device, and a control unit adapted for operating said system in a base mode unless a presence of such source of signals interfering with said wireless link is detected by said detecting means and for operating said system in an interference mode as long as a presence of such source of signals interfering with said wireless link is detected by said detecting means, in which interference mode transmission of said signals from said remote device to said hearing device is controlled such that said signals are transmitted in packets each having a length of not more than half a length of a shortest one of said low power regimes of said detected power scheme, with each packet subsequently being transmitted twice.

28. The system of claim 26, wherein said hearing device consists of a hearing instrument into which a receiver unit for said wireless link is integrated.

29. The system of claim 26, wherein said hearing device consists of a receiver unit for said wireless link and a hearing instrument including said stimulating means, wherein said receiver unit is mechanically and electrically connected to said hearing instrument.

* * * * *